US006998526B1

(12) United States Patent
Sims et al.

(10) Patent No.: US 6,998,526 B1
(45) Date of Patent: Feb. 14, 2006

(54) CAPO DEVICE FOR STRINGED MUSICAL INSTRUMENT

(76) Inventors: Christopher George Sims, Apt. 1, 280 Carling Avenue, Ottawa, Ontario (CA) K1S 2E2; Jonathan Edward Sims, 68 Lamoureux, Gatineau, Quebec (CA) J9H 1S1

( * ) Notice: Subject to any disclaimer, the term of this patent is extended or adjusted under 35 U.S.C. 154(b) by 0 days.

(21) Appl. No.: 10/957,595

(22) Filed: Oct. 5, 2004

(51) Int. Cl.
*G10D 3/00* (2006.01)

(52) U.S. Cl. ..... 84/318

(58) Field of Classification Search ..... 84/312 R, 84/315, 317, 318
See application file for complete search history.

(56) References Cited

U.S. PATENT DOCUMENTS 4,334,457 A * 6/1982 Spoonts, III ..... 84/318
4,798,119 A 1/1989 Leifheit ..... 84/314 R
5,056,397 A 10/1991 Leifheit ..... 84/318
6,013,868 A 1/2000 Sims et al. ..... 84/318
6,635,813 B1 * 10/2003 Campling ..... 84/318
2002/0112592 A1 8/2002 Gillis ..... 84/318

* cited by examiner

*Primary Examiner*—Kimberly Lockett
(74) *Attorney, Agent, or Firm*—David J. French

(57) ABSTRACT

A capo device for a stringed musical instrument having a series of strings extending along a fretboard with spaced frets, in which each string passes through an aperture in a capo element which is slidable on the string, each element being such that when held against the fretboard it stops the string on which it is mounted at the adjacent fret. The elements have horse-shoe type magnets which interact with a ferromagnetic fretboard to hold each element against the fretboard at one of a number of selected positions while allowing the element to be moved to a stored position when not in use. The stored position is provided between a string nut and a string guide which contacts the strings between the nut and tuning pegs for the strings, the elements being movable over the nut into the stored position. The fretboard preferably has no magnets.

15 Claims, 2 Drawing Sheets

CAPO DEVICE FOR STRINGED MUSICAL INSTRUMENT

BACKGROUND OF THE INVENTION

1. Field of the Invention

The present invention relates to a capo device for a stringed musical instrument having series of strings extending along a fretboard with a series of frets, i.e. an instrument such as a guitar, lute, banjo and the like. Such an instrument is played by plucking the strings while using fingers to stop selected strings by holding them pressed down onto the fretboard, the string being "stopped" by the adjacent fret.

2. Prior art.

The present invention is an improvement of the capo devices shown in our Canadian Patent No. 2,244,647, issued Nov. 11, 2000, and our U.S. Pat. No. 6,013,868 issued Jan. 11, 2000.

A capo, sometimes referred to as a "capotasto", is a device which can be used to hold strings independently of the fingers. Simple capo devices hold all the strings at once, usually against a particular fret, and change the basic key of the instrument. Other devices, referred to as single string capos, are known which can be used to press down and stop only selected strings.

U.S. Pat. No. 5,056,397, which issued Oct. 15, 1991 to Leifheit, was prior art to our aforesaid patents. This shows a kind of capo device for a guitar in which a series of movable capo type elements are provided each with a bore by which the element is slidably mounted on one of the strings and is individually locatable to stop a string at a particular selected location. Each element has an undercut recess in its underside and can be individually held in position by having this recess engage one of the frets, which are made to protrude from the fretboard. The elements of the Leifheit device stop the strings directly, rather than hold the string against an adjacent fret, as is more usual with capo devices.

U.S. Pat. Appln. No. 2002/0112592 to Gillis, published Aug. 22, 2002, shows a guitar with special fret structures which can receive clips capable of holding individual strings at selected stopped positions adjacent the raised portion of the fret structure. Unlike with our previous patent and the Leifheit device, the Gillis clips do not have any bore or aperture by which they are slidably retained on the strings and presumably could be lost.

The invention of our prior patents as aforesaid used movable elements slidably mounted on each of the strings, and magnets were used to hold the capo elements in selected places on the fretboard. The use of magnets is believed to make our elements easier to engage and disengage with the fretboard than those of the Leifheit or Gillis devices. Also, each element of our device stops the strings in the usual way by holding them against adjacent frets, unlike with Leifheit. Our invention also provided a storage area for the elements when they are not in use.

Our aforesaid prior patents covered broadly the idea of using permanent magnets on the fretboard, and/or a permanent magnet or magnets in each movable element. The magnets used in the movable capo elements were single short bar magnets having opposite poles at top and bottom, i.e. remote from and adjacent to the fretboard. While theoretically such movable elements could work with an unmagnetized, ferromagnetic (e.g. steel) fretboard, with magnets available to us at the time of our earlier invention it was preferred to have additional magnets inset in the fretboard to give adequate holding strength. With this arrangement, when the elements were being moved, they "floated" free of the wooden fretboard in between the inset magnets, and this allowed lateral movement to occur accompanied by a tendency for the magnets in the elements to cause these to stick together. For this reason our preference at the time was to use magnets only on the fretboard, and to use plain ferromagnetic steel as the movable elements; this option is shown in FIGS. 6 to 9 of our aforesaid patents.

The use of magnets only on the fretboard is relatively expensive in that many magnets are needed. For example, in the construction of FIGS. 6 to 9 of our patents, showing a six string guitar, twelve magnets are used between each of several adjacent pairs of frets. Using magnets only on the movable elements would result in a less expensive construction using many fewer magnets. Furthermore, when the guitar has steel strings, the presence of magnets in the fretboard can affect the string vibration. The present invention provides a construction in which magnets are used only on the movable capo elements, but in which, unlike in our prior patents, the design of the instrument is such that these magnets do not cause the elements to stick together to any degree that would cause problems. With this construction the fretboard can be simply constructed of ferromagnetic material, and does not need to incorporate magnets.

SUMMARY OF THE INVENTION

The present invention has many features in common with the that of our aforesaid patents in providing a capo device for a stringed instrument of the type described and having a series of strings extending along a fretboard, these features including a series of capo elements each preferably having an aperture whereby it is slidably retained on an associated string which passes through the aperture in the element, and each element having an underside adjacent said fretboard and being dimensioned so that when held against the fretboard by magnetic means the element stops the string on which it is mounted at the adjacent fret.

In accordance with one aspect of the present invention, the fretboard incorporates ferromagnetic material over at least the majority of its length, and the elements each incorporate a horseshoe type permanent magnet having opposed poles both located on the underside of said element so as to interact with the ferromagnetic material of the fretboard and which are capable of holding the element against the fretboard at one of a number of selected positions during the playing of the instrument, while allowing movement of the element along the respective string to a stored position when not in use. With this arrangement no magnets are required in the fretboard.

The reference to "horseshoe type magnet" is not intended to indicate that the magnets are any particular precise shape, but rather that they have their two poles spaced apart at one end of the magnet adjacent the fretboard, these poles being joined by a generally U-shaped body part of the magnet, so that both poles can contact a flat ferromagnetic part of the fretboard. Having the magnets arranged in this way allows adequate holding power when used with an unmagnetized, ferromagnetic fretboard. With this arrangement there is little or no "floating" of the elements as they are moved along the fretboard, and less tendency of the movable elements to move laterally and stick together, than was the case with our previous construction having a simple bar magnets in each element and individual inset magnets in the fretboard.

Preferably, the permanent magnet for each element includes two pole portions, preferably rectangular, spaced on opposite sides of the path of an associated string passing through the element aperture, and a bridging portion extending between upper parts of the pole portions remote from the underside of the element, the bridging portion passing over the side of the string path remote from the fretboard; i.e. each magnet straddles the string path.

The underside of each movable element may have ramp means at one of its ends to facilitate movement of the element over the frets. In the preferred embodiment the ramp means are such that the element may readily be tilted about the junction between the underside and the ramp means. The aperture in the element, instead of being a bore along much of the element as in our aforesaid patents, is confined to that end of the element having the ramp means so that the string does not substantially interfere with tilting of the element.

In a preferred embodiment, each capo element is provided with a resilient pad which contacts a side of the associated string remote from the fretboard, and the element also includes a set screw operable to increase pressure between the pad and the string.

Each element may be provided with a lug on its underside, and the fretboard may have a series of grooves associated with each fret, with each groove of the series associated with a string, the relationship of the lugs and grooves allowing a lug to enter a groove when the element is in a desired position for stopping a string against the associated fret, the lug acting to stabilize the lateral position of the element on the fretboard.

The ferromagnetic material of the fretboard may be in the form of a series of steel sheets positioned between adjacent frets.

While it is preferred, as in our previous designs, that the movable capo elements each have an aperture or bore for the associated string by which the element is retained on the associated string, in a simplified design the elements may simply each have an open-bottom recess which accommodates the string so that elements can easily be removed from the instrument.

In accordance with a further aspect of the invention, in a capo device for a musical instrument having a series of capo elements each with a recess or aperture and which is slidable on a string passing through the aperture, and in which the musical instrument has a stored position for the elements between a nut and an auxiliary guide, the height of each string in the area of the stored position may be adjusted independently of the other strings by screws similar to set screws. This is useful in ensuring that the presence of an element in the stored position does not affect the pitch of a string relative to the normal string tuning.

BRIEF DESCRIPTION OF THE DRAWINGS

Preferred embodiments of the invention will now be described by way of example with reference to the accompanying drawings, in which.

DETAILED DESCRIPTION

Figure 1:
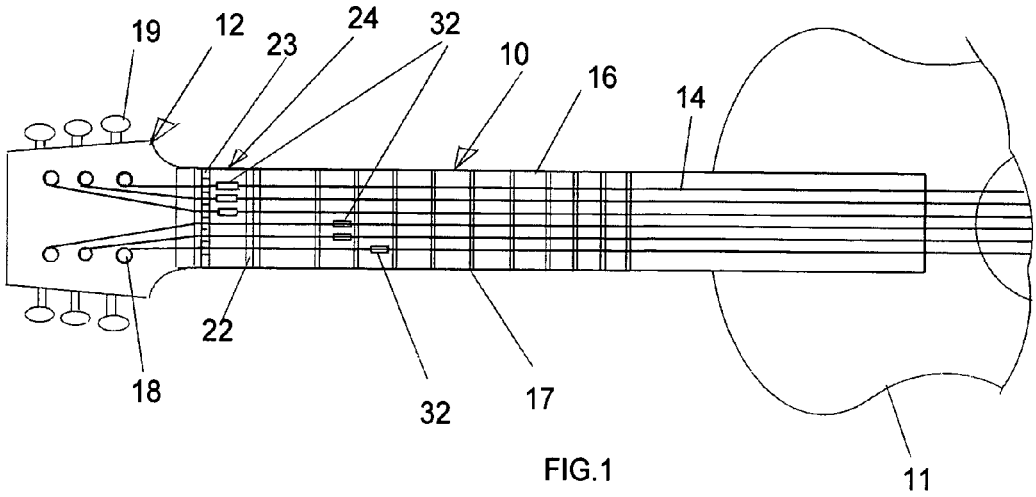
FIG. 1 is a top view of the fretboard portion of a guitar incorporating the invention.
Figure 2:
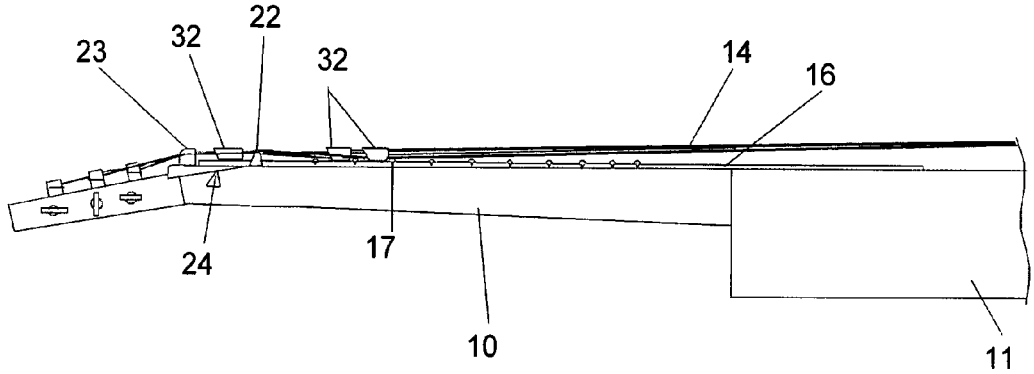
FIG. 2 is a side elevation of the same parts as shown in FIG. 1.
Figure 3:
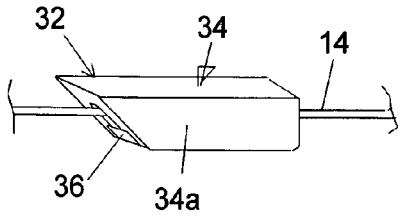
FIG. 3 is an enlarged, perspective view of one slidable capo element.

FIGS. 1 and 2 show the neck 10 of a guitar, this neck extending between the guitar body 11 and head 12. The body and the parts mounted on the body are conventional, and include a bridge (not shown) which anchors inner ends of the six strings 14. The strings extend along a fretboard 16 on the front face of the neck, having a parallel series of frets 17, and have their outer ends held by spindles 18 rotatable by tuning pegs 19, these parts also being conventional.

Figure 4:
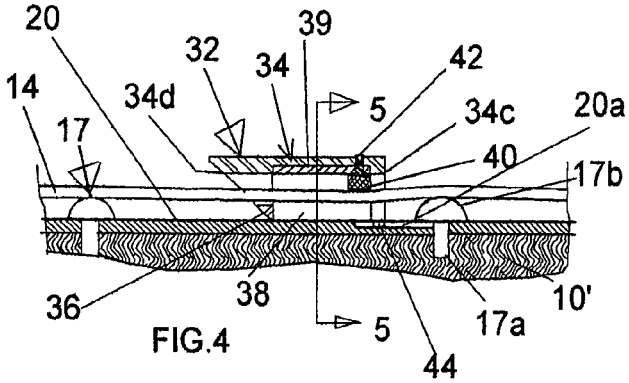
FIG. 4 is a sectional elevation of the same element and associated parts of the fretboard.

The frets 17 and associated parts of the fretboard are shown in detail in FIG. 4. Each fret has an anchor or blade portion 17*a* by which it is secured in the material 10' of the neck, and an outer, semi-cylindrical, head portion 17*b* which protrudes about 1 to 2 mm above the main surface of the fretboard and which can be used in the normal manner of a guitar fret while the instrument is played. The head portion has, on each side, a shoulder facing into the fretboard, and the adjacent shoulders of a pair of adjacent frets overlie the edges of a plate or sheet of ferromagnetic material 20 which is held on to the wooden material of the neck by epoxy adhesive. One of these plates 20 is used between each adjacent pair of frets, at least in the areas where the capo elements are to be used, so that these plates taken together occupy the major surface of the fretboard. The preferred material for the plates is a ferromagnetic stainless steel sold under the designation "430" stainless steel; the thickness of the plates 20 is preferably 16 gauge.

It is possible that the fretboard outer surface and frets might be made of an integral plate of ferromagnetic material; however it is preferred to use individual frets as described since these can be damaged in use and may need replacing.

As is usual, the vibrating portions of the strings terminate at a "string nut" 22, and pass from the nut onto the spindles 18. However, instead of diverging after passing over the nut, as is usual, as shown in FIGS. 1 and 2 here the strings remain parallel and substantially unbent until they pass over an upstanding auxiliary guide 23, after which they slope down towards the head and diverge towards the spindles. In the space between the nut 22 and the guide 23 is a holding area 24. This area has the same width as the neck and a length of about 1.5 cm; it provides stored positions for the capo elements to be described.

As will be described below in relation to FIGS. 7 and 8, the guide 23 has means to adjust the height of the strings in this holding area so that tuning can be maintained when the capo elements are in this area.

Each of the six strings 14 of the guitar has an associated movable capo element 32 which is slidable on the string. Details of these elements are shown in FIGS. 3 to 6.

Figure 6:
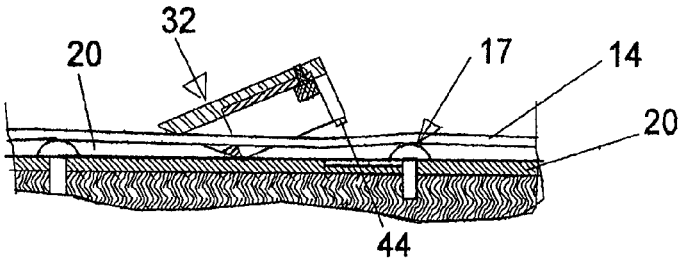
FIG. 6 is a side view similar to FIG. 4 with the element tilted for movement over frets.

As shown, each capo element 32 is generally rectangular, having a plastic casing 34 with flat side portions 34*a* and a flat top portion 34*b*, an inner end 34*c* (i.e. that end facing the guitar body 11) which is perpendicular to the sides and top, and an outer end 34*d* which is angled at about 40° to the top and underside and which forms ramp means to facilitate tilting and moving the element over frets. Below the top portion 34*b* the casing is longitudinally divided so that parallel side portions 34*a* can straddle a path for the guitar string 14, referred to herein as the "string path". Below the top 34*b* the side portions 34*a* are open throughout most of their length so that the string 14 can move in and out between these lower areas of the side portions, but at ramp end 34*d* the side members are joined, close to the element underside, by a closure member 36 of hard plastic (such as "Delrin") to retain the element on the string. Thus each element has an aperture above the member 36, between the side portions 34*a* and below the top 34*b*, by which it is slidably retained on the string 14. With this arrangement the element 32 can be tilted about the junction between its underside and the ramp end 34*d* as shown in FIG. 6 without significant distortion of the string 14.

Figure 5:
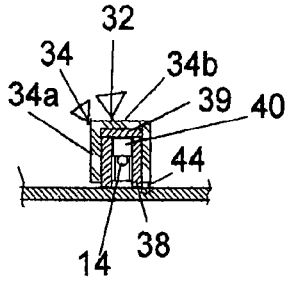
FIG. 5 is a cross-sectional view of the same element on lines 5—5 of FIG. 4.

In accordance with a principal feature of the invention, each capo element 32 is provided with a magnet of the "horseshoe" type, i.e. a magnet which has side-by-side poles capable of simultaneously contacting a flat surface, such as the ferromagnetic fretboard provided by steel plates 20. The "horseshoe" type magnets are each built up of two relatively thin, flat, rectangular pole pieces 38 orientated longitudinally of the element and in parallel relationship on opposite sides of the string path, each pole piece having a lower end surface level with the underside of the element 32 so that these pole end surfaces are capable of simultaneously contacting a steel plate 20, and each pole piece has an upper end located above the string path. These upper ends of the pole pieces are joined by a ferromagnetic bridging member 39 located on the underside of the top 34*b* of the casing 34, and above the string path, i.e. on the side of the string path remote from the fretboard. Thus, in cross-section as seen in FIG. 5, these parts form a horseshoe type magnet straddling the string path and with two opposed poles both capable of contacting the plate 20. The magnets are so-called "rare earth" permanent magnets, specifically neodymium-iron-boron magnets, preferably of N–35 strength or greater.

A further feature of this invention is a device for providing adjustable pressure or friction between a string and the associated capo element. This is provided by a small pad 40 of resilient material, such as leather or rubber, trapped between the outer side of string 14 and the inner side of the magnet bridging piece 39. Pressure between the pad and the string can be adjusted by a small set screw 42 extending through a threaded bore formed in the top portion 34*b* of the element casing and through the bridging piece 39.

The magnets are of suitable strength that when an element 32 is located between the frets as shown in FIG. 4, it holds the string 14 on which it is mounted against the fret 17 adjacent its inner end, effectively stopping this string in the same manner as a player's finger. The magnetic force can easily be overcome by the player using a finger to tilt the element as shown in FIG. 6, after which it is relatively easy to move the element along the string when this is to be repositioned. This allows for easy re-arrangement between songs. When the capo elements are not needed, they can be simply pushed to the end of the fretboard, with the ramp 34*d* allowing them to pass over the nut 22 into the stored position provided by the holding area 24.

A yet further feature of the capo element 32 is a small lug 44 projecting down from the front end of one of the side members of casing 34. This interacts with one of a series of six small longitudinal grooves 20*a* formed in each of the ferromagnetic plates 20 adjacent the outer side of each fret. The grooves are located relative to the string positions so that the lug 44 can enter a corresponding groove when the element is properly placed to stop a string, as in the FIG. 4 position, and the effect of the groove on the lug is to stabilize the lateral position of the capo element and to prevent any undesirable lateral movement.

Figure 7:
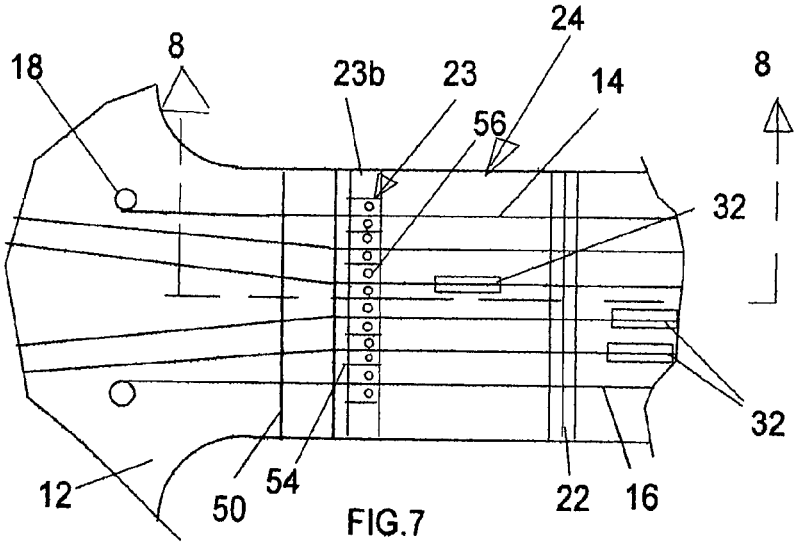
FIG. 7 is an enlarged top plan view of the construction of the head end of the guitar.
Figure 8:
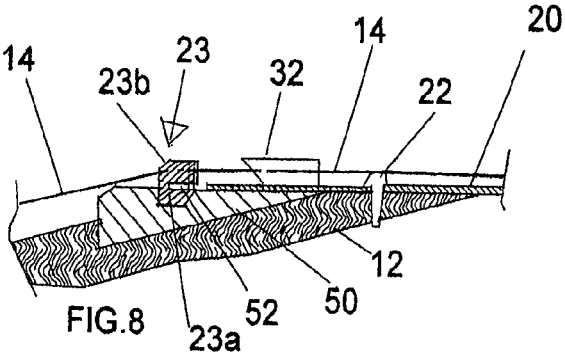
FIG. 8 is a side elevation of parts shown in FIG. 7.

FIGS. 7 and 8 show in more detail the arrangement at the head of the guitar, in which the nut 22 provides a transition into the holding area 24. A special adjustable string guide 23 is provided formed from an integral body of plastic material having base portion 23*a* inset into a body of ebony material 50 which is itself inset into the wooden neck of the guitar and which provides a base for storage area 24 generally co-planar with the fretboard. The base portion 23*a* of the string guide is partially separated by groove 52 from an upper portion 23*b*, which is itself divided into six laterally spaced groove elements by partial longitudinal slits 54. Each of these groove elements has a longitudinal groove accommodating a string 14. At the side of each slit is a threaded bore, perpendicular to the plane of the neck, each bore having a screw 56, similar to a set screw, which impinges on the base portion 23*a* at the lower side of groove 52. The two screws 56 on opposite sides of each string can be adjusted, preferably in an even manner, to adjust the height of the groove element and thus of the string in the holding area. This adjustment is made with the associated capo element situated in the holding area so as to ensure that placing a capo in this area does not affect the tension and thus the proper pitch of an open string extending from the nut 22.

In use the capo elements are moved from the holding area, as required, by finger pressure being applied to the ramp end of the respective element, causing it tilt as shown in FIG. 6, in which position it can easily be slid along the fretboard and over the frets.

We claim:

1. A capo device for a stringed musical instrument having a series of strings extending along a fretboard with spaced frets, the device comprising:

a series of capo elements each having a recess or aperture, each said element being slidable on an associated string which passes along a string path and through said recess or aperture in the element, each said element having an underside adjacent said fretboard and being dimensioned so that when held against the fretboard the element stops the string on which it is mounted at the adjacent fret, wherein said fretboard incorporates ferromagnetic material;

and wherein said elements each incorporate a horseshoe type permanent magnet having opposed poles both located on the underside of said element so as to interact with said ferromagnetic material and being capable of holding said element against the fretboard at one of a number of selected positions during the playing of the instrument, while allowing movement of the element along the respective string to a stored position when not in use.

2. A capo device according to claim 1, wherein the fretboard is ferromagnetic along substantially its full length.

3. A capo device according to claim 1, wherein the permanent magnet for each element includes two pole portions spaced on opposite sides of the string path, and a bridging portion extending between upper parts of said pole portions remote from the underside of the element, so that said pole and bridging portions straddle the string path.

4. A capo device according to claim 1, each element has an aperture by which it is retained on the associated string, and wherein the underside of each said element has ramp means at one of its ends allowing tilting of the element to facilitate movement of the element over the frets, said aperture in the element being confined to that end of the element having the ramp means so that the string does not substantially interfere with tilting of the element.

5. A capo device according to claim 1, wherein said element is provided with a resilient pad which contacts a side of the associated string remote from the fretboard, and wherein said element also includes a set screw operable to increase pressure between the pad and the string.

6. A capo device according to claim 1, wherein each capo element is provided with a lug on its underside, and wherein said fretboard has a series of grooves associated with each of several frets, with each groove of each series associated with a string, the relationship of the lugs and grooves allowing a lug to enter a groove when the element is in a desired position for stopping a string against the associated fret so that the lug and groove relationship stabilizes the lateral position of the element on the fretboard.

7. A capo device according to claim 1, wherein the ferromagnetic material of the fretboard is in the form of a series of steel sheets positioned between adjacent frets.

8. A capo device according to claim 1, wherein the fretboard is free of magnets.

9. A capo device for a stringed musical instrument having a series of strings extending along a fretboard with spaced frets, the device comprising:

a series of capo elements each having an aperture, each said element being slidably retained on one of an associated string which passes through said aperture in the element, each element having an underside adjacent said fretboard and being dimensioned so that when held against the fretboard the element stops the associated string passing through its aperture, wherein said fretboard incorporates ferromagnetic material along at least the major portion of its length;

and wherein said elements each incorporate a permanent magnet adapted to interact with said ferromagnetic material and being capable of holding each element against the fretboard at one of a number of selected positions during the playing of the instrument, while allowing movement of the element along the respective string to a stored position when not in use, and and wherein material of the fretboard is in the form of a series of ferromagnetic sheets positioned between adjacent frets.

10. A capo device according to claim 9, wherein the undersides of said elements have ramp means at one of their the ends allowing tilting of the elements to facilitate movement of said elements over the frets, said aperture in each element being confined to the end of the element having the ramp means so that the string does not substantially interfere with tilting of the element.

11. A capo device according to claim 9, wherein each said element is provided with a resilient pad which contacts a side of the associated string remote from the fretboard, and wherein said element also includes a set screw operable to increase pressure between the pad and the string.

12. A capo device according to claim 9, wherein each element is provided with a lug on its underside, and wherein said fretboard has a series of grooves associated with each fret, with each groove of each series associated with a string, the relationship of the lugs and grooves allowing a lug to enter a groove when the element is in a desired position for stopping a string, so as to stabilize the lateral position of the element on the fretboard.

13. A capo device according to claim 9, wherein the fretboard is free of magnets.

14. A capo device for a stringed musical instrument having a series of strings extending along a fretboard with spaced frets, the device comprising:

a series of capo elements each having an aperture, each said element being slidable on an associated string which passes through said aperture in the element, each said element having an underside adjacent said fretboard and being dimensioned so that when held against the fretboard the element stops the associated string passing through its aperture, wherein said elements and the fretboard have interacting means capable of holding each element against the fretboard during the playing of the instrument while allowing movement of the element over the frets to a holding area when not in use, said holding area being defined between an end stop which terminates the vibrating portion of the strings and a string guide which contacts the strings between the end stop and tuning pegs, said elements being movable over said end stop into the stored position, and wherein the string guide is formed with adjustment means to allow independent adjustment of the height of each string in the holding area independently of the other strings, such as to enable adjustment of the tension in the associated string when the associated capo element is in the holding area.

15. A capo device according to claim 14, wherein said adjustment means includes a series of string holding groove elements each associated with one of said strings, said groove elements being separated by slits, and in which the height of said groove elements are individually adjustable by screws located in said groove elements.

* * * * *